US006432549B1

(12) United States Patent
Kronzer

(10) Patent No.: US 6,432,549 B1
(45) Date of Patent: Aug. 13, 2002

(54) CURL-RESISTANT, ANTISLIP ABRASIVE BACKING AND PAPER

(75) Inventor: Francis Joseph Kronzer, Woodstock, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/141,052

(22) Filed: Aug. 27, 1998

(51) Int. Cl.[7] ..... B32B 25/02; B32B 25/04; B32B 25/06; B32B 25/10; B32B 25/14

(52) U.S. Cl. ..... 428/481; 428/480; 428/482; 428/483; 428/500; 428/515; 428/507; 428/511; 428/512; 428/513; 442/394; 442/395; 442/398; 442/399; 51/298; 51/299; 51/307

(58) Field of Search ..... 428/480, 487, 428/507, 511, 512, 513, 481, 482, 500, 515; 51/298, 299, 307; 442/394, 395, 398, 399

(56) References Cited

U.S. PATENT DOCUMENTS

| | | | | | |
|---|---|---|---|---|---|
| 1,581,657 | A | | 4/1926 | Okie et al. | |
| 2,136,150 | A | | 11/1938 | Oglesby | 51/280 |
| 2,165,186 | A | | 7/1939 | Walker et al. | 51/280 |
| 2,230,934 | A | | 2/1941 | Carlton et al. | 51/298 |
| 2,236,597 | A | | 4/1941 | Hatch et al. | 51/298 |
| 2,305,157 | A | | 12/1942 | Ham et al. | 51/295 |
| 2,317,650 | A | | 4/1943 | Stratford | 51/298 |
| 3,014,795 | A | | 12/1961 | Schmidlin | 51/297 |
| 3,306,718 | A | | 2/1967 | Chapin | 51/297 |
| 3,615,303 | A | | 10/1971 | Singer et al. | 51/295 |
| 3,619,150 | A | | 11/1971 | Rinker et al. | 51/295 |
| 3,861,892 | A | | 1/1975 | Wisdom et al. | 51/295 |
| 4,035,961 | A | | 7/1977 | Pemrick et al. | 51/295 |
| 4,084,941 | A | | 4/1978 | Cox et al. | 51/295 |
| 4,111,667 | A | | 9/1978 | Adams | 51/295 |
| 4,113,900 | A | | 9/1978 | Lawton | 427/207 R |
| 4,140,829 | A | | 2/1979 | Pemrick et al. | 428/246 |
| 4,163,647 | A | | 8/1979 | Swiatek | 51/295 |
| 4,225,321 | A | | 9/1980 | Swiatek | 51/295 |
| 4,240,807 | A | | 12/1980 | Kronzer | 51/295 |
| 4,275,137 | A | | 6/1981 | Verhoof | 430/149 |
| 4,386,943 | A | | 6/1983 | Gümbel et al. | 51/298 |
| 4,457,766 | A | | 7/1984 | Caul | 51/298 |
| 4,536,454 | A | * | 8/1985 | Haasl | 428/516 |
| 4,629,473 | A | | 12/1986 | Ruid et al. | 51/295 |
| 4,642,126 | A | | 2/1987 | Zador et al. | 51/295 |
| 4,745,139 | A | * | 5/1988 | Haasl et al. | 523/149 |
| 4,903,440 | A | | 2/1990 | Larson et al. | 51/298 |
| 5,061,294 | A | | 10/1991 | Harmer et al. | 51/295 |
| 5,109,638 | A | | 5/1992 | Kime, Jr. | 51/401 |
| 5,213,589 | A | | 5/1993 | Ronning et al. | 51/293 |
| 5,296,447 | A | | 3/1994 | Suto et al. | 503/227 |
| 5,304,224 | A | | 4/1994 | Harmon | 51/295 |
| 5,316,812 | A | | 5/1994 | Stout et al. | 428/64 |
| 5,378,252 | A | | 1/1995 | Follensbee | 51/298 |
| 5,417,726 | A | | 5/1995 | Stout et al. | 51/293 |
| 5,456,975 | A | | 10/1995 | Zador et al. | 428/241 |
| 5,520,957 | A | * | 5/1996 | Bange et al. | 427/208.8 |
| 5,534,575 | A | * | 7/1996 | Foster et al. | 524/270 |
| 5,539,033 | A | * | 7/1996 | Bredahl et al. | 525/270 |
| 5,551,961 | A | * | 9/1996 | Engen et al. | 51/298 |
| 5,578,095 | A | | 11/1996 | Bland et al. | 51/295 |
| 5,580,634 | A | | 12/1996 | Stout et al. | 428/65.9 |
| 5,582,625 | A | | 12/1996 | Wright et al. | 51/295 |
| 5,589,034 | A | | 12/1996 | Hultman et al. | 162/111 |
| 5,611,825 | A | | 3/1997 | Engen et al. | 51/295 |
| 5,624,471 | A | | 4/1997 | Gaeta et al. | 51/295 |
| 5,643,669 | A | | 7/1997 | Tsuei | 428/354 |
| 5,662,997 | A | | 9/1997 | Onishi et al. | 428/331 |
| 5,669,940 | A | | 9/1997 | Stubbs | 51/295 |
| 5,690,787 | A | | 11/1997 | Hultman et al. | 162/112 |
| 5,766,277 | A | * | 6/1998 | Devoe et al. | 51/295 |
| 5,774,164 | A | | 6/1998 | Yamazaki et al. | 347/221 |
| 5,798,175 | A | * | 8/1998 | Tynan, Jr. et al. | 428/355 EN |
| 5,824,623 | A | | 10/1998 | Kawai et al. | 503/227 |
| 5,834,154 | A | | 11/1998 | Yamazaki et al. | 430/201 |
| 5,876,836 | A | | 3/1999 | Imamura et al. | 428/195 |
| 5,922,784 | A | * | 7/1999 | Devoe et al. | 522/165 |
| 6,017,636 | A | | 1/2000 | Tada et al. | 428/423 |

FOREIGN PATENT DOCUMENTS

| | | |
|---|---|---|
| EP | 0344529 A1 | 5/1989 |
| EP | 0 237 784 B1 | 6/1991 |
| EP | 0 587 171 A1 | 3/1994 |

* cited by examiner

*Primary Examiner*—Vivian Chen
(74) *Attorney, Agent, or Firm*—James B. Robinson; William E. Maycock; Steven D. Flack

(57) ABSTRACT

A curl-resistant, antislip abrasive backing which includes a polymer-reinforced paper having a first surface and a second surface; a synthetic polymeric layer bonded to the first surface; and an amorphous, rubbery polymer film layer bonded to the second surface. Also provided is a curl-resistant, antislip abrasive paper which includes a polymer-reinforced paper having a first surface and a second surface; a synthetic polymeric layer bonded to the first surface; a layer of abrasive particles bonded to the synthetic polymer layer; and an amorphous, rubbery polymer film layer bonded to the second surface. By way of examples, the amorphous, rubbery polymer may be a polyester elastomer or an amorphous, rubbery polypropylene.

6 Claims, No Drawings

CURL-RESISTANT, ANTISLIP ABRASIVE BACKING AND PAPER

BACKGROUND OF THE INVENTION

The present invention relates to an abrasive substrate. More particularly, the present invention relates to a latex-impregnated paper intended for use as an abrasive backing.

The reinforcement of paper by latex polymer impregnation (commonly referred to as latex saturation) is a long-established practice. The polymer employed typically is a synthetic material, most often a latex, and the paper may consist solely of cellulosic fibers or of a mixture of cellulosic and noncellulosic fibers. Polymer reinforcement is employed to improve one or more of such properties as dimensional stability, resistance to chemical and enviromental degradation, resistance to tearing, embossability, resiliency, conformability, moisture and vapor transmission, and abrasion resistance, among others.

Latex saturated papers typically have been used as label print stock, base substrates for abrasive paper, and similar applications where strength is an essential requirement. Currently, backside coatings for abrasive papers provide antislip properties when wet, some degree of water repellency, and perhaps some curl prevention. Nevertheless, there still is an opportunity for improved curl resistance and antislip properties of abrasive backings and papers.

SUMMARY OF THE INVENTION

The present invention addresses some of the difficulties and problems discussed above by providing a curl-resistant, antislip abrasive backing which includes a polymer-reinforced paper having a first surface and a second surface; a synthetic polymeric layer bonded to the first surface; and an amorphous, rubbery polymer film layer bonded to the second surface.

The present invention also provides a curl-resistant, antislip abrasive paper which includes a polymer-reinforced paper having a first surface and a second surface; a synthetic polymeric layer bonded to the first surface; a layer of abrasive particles bonded to the synthetic polymer layer; and an amorphous, rubbery polymer film layer bonded to the second surface.

By way of example only, the amorphous, rubbery polymer may be a polyester elastomer. As another example, the amorphous, rubbery polymer may be an amorphous, rubbery polypropylene. Additional examples include polyurethenes and polyethers. For example, the polymer may be a polyetherester, such as Arnitel® EM400, which polymers are described more fully in, e.g., U.S. Pat. No. 4,707,398 to Boggs, which patent is incorporated herein by reference in its entirety. Amitel® EM400 is available from A. Schulman of Akron, Ohio, or Akzo Plastics of Arnhem, Holland.

DETAILED DESCRIPTION OF THE INVENTION

As used herein, the term "backside layer" refers to a layer or coating on the backside of an abrasive paper, i.e., the side of the abrasive paper which does not have the layer of abrasive particles thereon.

The term "abrasive backing" is used herein to mean a paper, typically a polymer-reinforced paper, which is intended to be provided with a layer of abrasive particles. The term "abrasive paper" refers to the combination of an abrasive backing and a layer of abrasive particles.

As used herein, the term "paper" is meant to include any web or sheet-like material which contains at least about 50 percent by weight of cellulosic fibers. In addition to cellulosic fibers, the web may contain other natural fibers, synthetic fibers, or mixtures thereof. Cellulosic nonwoven webs may be prepared by air laying or wet laying relatively short fibers to form a web or sheet. Thus, the term includes sheets prepared from a papermaking furnish. Such furnish may include only cellulose fibers or a mixture of cellulose fibers with other natural fibers and/or synthetic fibers. The furnish also may contain additives and other materials, such as fillers, e.g., clay and titanium dioxide, surfactants, antifoaming agents, and the like, as is well known in the papermaking art.

As a practical matter, the abrasive paper of the present invention will be prepared from a latex-impregnated paper. By way of illustration only, the latex-impregnated paper may be a water leaf sheet of wood pulp fibers or alpha pulp fibers impregnated with a reactive acrylic polymer latex such as Rhoplex® B-15 (Rohm and Haas Company, Philadelphia, Pa.). However, any of a number of other latices may be used, if desired, some examples of which are summarized in Table A, which follows.

TABLE A

Suitable Latices for Impregnation of Paper

| Polymer Type | Product Identification |
|---|---|
| Polyacrylates | Hycar ® 26083, 26084, 26120, 26104, 26106, 26322, B. F. Goodrich Company, Cleveland, Ohio<br>Rhoplex ® HA-8, HA-12, NW-1715, Rohm and Haas Company, Philadelphia, Pennsylvania<br>Carboset ® XL-52, B. F. Goodrich Company, Cleveland, Ohio |
| Styrene-butadiene copolymers | Butofan ® 4264, BASF Corporation, Sarnia, Ontario, Canada<br>DL-219, DL-283, Dow Chemical Company, Midland, Michigan |
| Ethylene-vinyl acetate copolymers | Dur-O-Set ® E-666, E-646, E-669, National Starch & Chemical Co., Bridgewater, New Jersey |
| Nitrile rubbers | Hycar ® 1572, 1577, 1570 x 55, B. F. Goodrich Company, Cleveland, Ohio |
| Poly(vinyl chloride) | Vycar ® 352, B. F. Goodrich Company, Cleveland, Ohio |
| Poly(vinyl acetate) | Vinac XX-210, Air Products and Chemicals, Inc. Napierville, Illinois |
| Ethylene-acrylate copolymers | Michem ® Prime 4990, Michelman, Inc., Cincinnati, Ohio<br>Adcote 56220, Morton Thiokol, Inc., Chicago, Illinois |

The impregnating dispersion typically will contain clay and an opacifier such as titanium dioxide. Exemplary amounts of these two materials are 16 parts and 4 parts, respectively, per 100 parts of polymer on a dry weight basis. By way of example only, the first layer may have a basis weight of 13.3 lbs/1300 $ft^2$ (50 $g/m^2$) before impregnation.

The impregnated paper generally may contain impregnant in a range of from about 5 to about 50 percent by weight, on a dry weight basis, although in some cases higher levels of impregnant in the paper may be suitable. As an illustration, the paper may contain 18 parts impregnating solids per 100 parts fiber by weight, and may have a basis weight of 15.6 lbs/1300 $ft^2$ (58 $g/m^2$), both on a dry weight basis. A suitable caliper is 3.8±0.3 mil (97±8 micrometers).

As already stated, the curl-resistant, antislip abrasive backing of the present invention includes a polymer-reinforced paper having a first surface and a second surface; a synthetic polymeric layer bonded to the first surface; and an amorphous, rubbery polymer film layer bonded to the second surface.

The curl-resistant, antislip abrasive paper of the present invention includes a polymer-reinforced paper having a first surface and a second surface; a synthetic polymeric layer bonded to the first surface; a layer of abrasive particles bonded to the synthetic polymer layer; and an amorphous, rubbery polymer film layer bonded to the second surface.

By way of example only, the amorphous, rubbery polymer may be a polyester elastomer. As another example, the amorphous, rubbery polymer may be an amorphous, rubbery polypropylene.

The amorphous, rubbery polymer film layer in general may be formed on the second surface of the paper by melt-extrusion or extrusion-casting techniques which are well known to those having ordinary skill in the art. Alternatively, a preformed film of the amorphous, rubbery polymer may be bonded to the second side of the paper, again by known means.

In general, the amorphous, rubbery polymer film layer may be of any desired thickness, depending upon the requirements of the abrasive paper. For example, the amorphous polymer film layer may have a thickness of from about 0.2 to about 3 mils (from about 5 to about 75 micrometers). As another example, the amorphous polymer film layer may have a thickness of from about 0.5 to about 1 mil (from about 12 to about 25 micrometers).

The present invention is further described by the example which follows. Such example, however, is not to be construed as limiting in any way either the spirit or the scope of the present invention.

EXAMPLE

The paper used in this example was a commercially available saturated paper (Tan "C" weight, Kimberly-Clark Corporation, Roswell, Georgia). Sheet size was 8.5×11 inches (about 22×28 cm). The basis weight of the paper before saturation was about 98.5 grams per square meter (gsm). The saturant was a styrene-butadiene rubber latex and was present at a level sufficient to give the saturated paper a basis weight of 134 gsm.

One side of the paper was extrusion coated with low density polyethylene or with one of two different rubbery, amorphous polymers, referred to hereinafter as Polymers A, B, and C, respectively. In each case, the thickness of the extruded film was 1 mil (about 25 micrometers). Polymer B was a polyester elastomer (Hytrel® 3548, DuPont Company, Polymer Products, Packaging Products Division, Wilmington, Del.), and Polymer C was an amorphous, rubbery polypropylene (Himont K S0-84P, Himont USA, Wilmington, Del.).

Each sample was evaluated by touch when dry and after soaking in water. The sample coated with Polymer A was slippery, both when dry and when wet. The sample coated with Polymer B had excellent dry antislip properties and good wet antislip properties. The sample coated with Polymer C had good dry antislip properties and excellent wet antislip properties. There was no apparent change in any of the sample after soaking in water for 24 hours; each sample remained flat.

While the specification has been described in detail with respect to specific embodiments thereof, it will be appreciated by those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A curl-resistant antislip abrasive backing comprising:

a polymer-reinforced paper having a first surface and a second surface;

a synthetic polymeric layer bonded to the first surface; and an amorphous, rubbery polymer film layer bonded to the second surface, wherein said amorphous rubbery polymer film layer is produced from either melt-extrusion, extrusion casting or a preformed film and is selected from the group consisting of polyester elastomers and amorphous rubbery polypropylene, and wherein said curl resistant antislip abrasive backing demonstrates antislip properties when either dry or wet, and further wherein said curl-resistant antislip abrasive backing is curl-resistant upon exposure to liquid water.

2. The curl-resistant, antislip abrasive backing of claim 1, in which the amorphous, rubbery polymer is a polyester elastomer.

3. The curl-resistant, antislip abrasive backing of claim 1, in which the amorphous, rubbery polymer is an amorphous, rubbery polypropylene.

4. A curl-resistant antislip abrasive paper that is curl-resistant upon exposure to liquid water, comprising:

a polymer-reinforced paper having a first surface and a second surface;

a synthetic polymeric layer bonded to the first surface;

a layer of abrasive particles bonded to the synthetic polymer layer; and an amorphous, rubbery polymer film layer bonded to the second surface, wherein said amorphous rubbery polymer film layer is produced from either melt-extrusion, extrusion casting or a preformed film, and is selected from the group consisting of polyester elastomers and amorphous rubbery polypropylene, and wherein said curl resistant antislip abrasive paper demonstrates antislip properties when either dry or wet, and further wherein said curl-resistant antislip abrasive paper is curl-resistant upon exposure to liquid water.

5. The curl-resistant, antislip abrasive paper of claim 4, in which the amorphous, rubbery polymer is a polyester elastomer.

6. The curl-resistant, antislip abrasive paper of claim 4, in which the amorphous, rubbery polymer is an amorphous, rubbery polypropylene.

* * * * *